US005816702A

United States Patent [19]

Mays et al.

[11] Patent Number: 5,816,702

[45] Date of Patent: Oct. 6, 1998

[54] DRUM WITH INTERNAL STATIC MIXER

[75] Inventors: Harry Mays, Merced; Michael Morrison, Stockton, both of Calif.

[73] Assignee: North American Packaging (Pacific Rim) Corporation, Merced, Calif.

[21] Appl. No.: 706,384

[22] Filed: Aug. 30, 1996

[51] Int. Cl.[6] ..... B01F 9/02

[52] U.S. Cl. ..... 366/228; 366/57

[58] Field of Search ..... 366/225, 227, 366/228, 230, 57

[56] References Cited

U.S. PATENT DOCUMENTS

| | | | |
|---|---|---|---|
| 60,134 | 12/1866 | Bruckner | 366/228 |
| 1,918,679 | 7/1933 | Witherspoon | 366/229 |
| 4,501,499 | 2/1985 | Boan et al. | 366/227 |
| 5,492,407 | 2/1996 | Gement | 366/228 |

FOREIGN PATENT DOCUMENTS

| | | | |
|---|---|---|---|
| 428607 | 12/1947 | Italy | 366/228 |
| 2254797 | 10/1993 | United Kingdom | 366/219 |

*Primary Examiner*—Tony G. Soohoo

*Attorney, Agent, or Firm*—Townsend and Townsend and Crew

[57] ABSTRACT

A mixing vane is mounted interior of a drum having a plastic lining—preferably a vinyl lining. Preferably two mixing vanes covers a cylindrical solid angle of 240° while 120° remains unoccupied to permit convenient pouring of the contents from the barrel. The mixing vane is preferably constructed with a L-shaped section with the bottom of the "L" fitted to the interior of the lined drum and the vertical member of the "L" protruding outward from the barrel wall as the mixing vane. In the preferred embodiment, the vertical member of the "L" is disposed along a helical path to produce directional movement of the barrel contents during barrel rotation. Preferably, the mixing vane is injection molded from vinyl or polyethylene. In fastening to the sidewall of the 55 gallon, the mixing vane is softened at the bottom of the "L" by either placement in a vinyl solvent or heating to produce a sticky surface. The vane is placed, preferably by clamping, to the inside surface of the vinyl coated 55 gallon drum. There results a complete and simple bond of the vane to the drum which can withstand the temperatures of materials placed within the drum and effect desired mixing of the drum contents.

6 Claims, 6 Drawing Sheets

DRUM WITH INTERNAL STATIC MIXER

This application follows on with the material set forth in U.S. patent application Ser. No. 08/501,676, filed Jul. 12, 1995 (now U.S. Pat. No. 5,651,613 issued Jul. 29, 1997) entitled Drum with Internal Static Mixer. Accordingly, the contents of this previous application is incorporated by reference as if set forth in total herein.

Additionally, a method and apparatus for the attachment of plastic mixing vanes to an already interior coated disposable 55 gallon drum is set forth. Regarding this portion of the disclosure, the continuation materials herein claim priority from Applicant's Provisional patent application Ser. No. 60/010,845 filed Jan. 30, 1996 entitled Drum with Mixing Vane and from Applicant's additional filed Provisional Patent Application Ser. No. 60/021,456 filed Jul. 17, 1996 entitled Drum with Mixing Vane.

A disposable drum of the standard 55 gallon variety is provided with mixing vanes over a partial cylindrical solid angle of the drum. Improved cooling results in standard cooling spray tunnels. Furthermore, the drum contents can easily be poured from the drum.

BACKGROUND OF THE INVENTION

So-called "55 gallon" drums are used for both storage and transport of numerous liquid or semi-liquid products. Unfortunately, products once placed in such drums undergo little mixing. Some discussion of the construction of "55 gallon" drums can explain this inherent lack of mixing.

A closed head 55 gallon drum consists of a steel cylinder provided with two cylindrical ribs formed by internally cold working the steel cylinder. Circular bottom and top steel lids close both ends of the cylinder with the cylinder sides and circular periphery of the lids being mechanically seamed into a fluid tight joint to close the cylinder. In the case of the closed head drum intended for this application, the top circular lid is provided with a 4½" diameter central opening or bung. It is through this opening or bung that the drum is filled with product. After filling the drum is sealed by inserting a cap in the opening and swaging it in.

So-called "open head" 55 gallon drums are known. These drums have a head which is approximately the same diameter as the drum itself. In this case, one end of the drum defines a seat for a removable head having the same dimension as the end of the drum. Typically, when the drum is filled with product, the head is placed and secured typically with a "bolt ring"—a removable ring which extends around the drum to protect the removable head at its seat from disruption during storage and transport.

When a drum is moved, it is either lifted—usually on a pallet with other drums, or rolled. Lifting effects little mixing. Likewise, rolling effects little mixing. When the drum is rolled, the cylindrical side wall of the drum develops some relative movement to the contained product. However, since the drum is symmetrical about an axis though the center of the cylindrical side walls, and closed by two circular end walls, rolling of the drum occurs with little product movement with respect to the cylindrical side wall of the drum. Thus, rolling of the drum produces little more mixing that lifting of the drum. Standard 55 gallon drums include an actual capacity of 57 gallons. Usually such drums are loaded with 55 gallons of product to be transported and stored. The remaining space in such 55 gallon drums—that is, the remaining 2 gallons of capacity—is left as free space. Normally this space is occupied with a gas and defines a "free surface" at the interface between the gas and the rest of the product contained within the 55 gallon drum. This free surface, however, does little to promote internal mixing.

There is a need for mixing in such 55 gallon drums. This need can best be understood by considering the case of a closed head 55 gallon drum immediate after the drum has been loaded with hot, freshly cooked diced tomatoes.

In the case of hot, freshly cooked diced tomatoes, the drum is filled with a product which needs to be rapidly cooled. Where the product can be immediately cooled, the cooked and cooled diced tomatoes have a firm consistency and desirable food consistency. In the absence of relatively rapid cooling, the diced tomatoes lose their consistency and become soft and mush like. The diced tomato product loses its food texture and consequently its value.

Current techniques for rapidly cooling the hot diced tomato product include passing the drum between a series of stations. At each station, the drum is rotated, rocked, and simultaneously sprayed with water. Some consideration of how a standard cooling tunnel operates can be helpful.

FIG. 1 illustrates a cooling station utilized for passing drums with hot cooked tomatoes between sequential cooling stations for effecting cooling of their contents. The reader will understand that the invention herein is shown. However, for purposes of setting forth the prior art, a typical cooling station will now be discussed.

Simply stated, 55 gallon drums are passed between discrete cooling stations. During the dwell time at each cooling station, the drums are rotated. During passage between the respective stations, rotation is abruptly terminated. When the drum reaches the cooling station, just as abruptly, rotation again commences.

In the absence of internal static mixers, this cooling technique is deficient. As the drum is rotated, rocked and sprayed, product adjacent the cylindrical side wall of the drum is rapidly cooled and maintains a firm texture. Unfortunately, product in the central axial portion of the drum is not cooled as rapidly and continues to cook slowly due to the ambient heat in the drum until the rocking motion works the product to the walls. The continued cooking produces the undesirable mush texture in the tomato product.

RELEVANT PRIOR ART

In Wild U.S. Pat. No. 4,565,452 issued Jan. 21, 1986, entitled COOLING APPARATUS, a cooling scheme is set forth for drum contained cooked product—in this case spiced diced fruit preparations. Cylindrical containers receiving the hot fruit preparation to be cooled are provided with internal fins, preferably helically disposed.

In contrast with the disclosure that follows, the drums utilized in Wild are not disposable. The mixing fins are made of sheet metal. Further, the drums are made to have their contents filled by specialized fittings at the top of the containers and to drain after cooling from specialized fittings at the bottom of the containers.

When filled with hot fruit product, these containers are lowered into and submersed within a cooling bath. Within the cooling bath, the containers contact rollers on their cylindrical sides. The containers are continuously rotated and advanced parallel to the spin axis of the containers the length of the cooling bath. During this continuous rotating, product within the containers is cooled.

In the preferred embodiment, Wild discloses two baths, each bath having the rotating and advancing mechanism. Drums loaded with product are partially cooled in one bath, loaded with spices to be thoroughly mixed, and then placed in the remainder of the basket for final cooling.

It will be realized that the drums of Wild are at least buoyantly supported and therefore have a greatly reduced weight. Modern cooling tunnels which utilize a chilled water spray require rapid rates of rotation—in the order of 20 to 30 rpm. Totally immersed drums having reduce weight and fluid friction are not generally capable of these rapid rates of rotation.

Disposable 55 gallon open head drums are commonly used for the transport of food product—especially diced tomatoes. This diced tomato product is highly acidic. This being the case, the drums are first provided with a thin plated tin layer. Thereafter, this layer is coated to reduce attack of the tin of the barrel by the acidic contents. In this environment, sheet metal mixing vanes such as those utilized in Wild are not practical.

Finally, the contents of such drums must be readily removable. For this reason, open head drums are utilized. Alternately, tight head drums can be used and the heads cut off to remove the contents. We have discovered that conventional mixing vanes which extend substantially around the complete inside of the periphery of such barrels interfere with the removal of the contents from the barrel. This is unacceptable.

SUMMARY OF THE INVENTION

A disposable 55 gallon drum is provided with internal mixing vanes over a limited cylindrical solid angle of the interior surface of the barrel—this limited cylindrical solid angle being in the order of 240°. The remaining solid angle, being in the order of 120°, is not occupied by mixing vanes. There results a disposable barrel which can cool product effectively, can be used for transport of the cooled product, and thereafter can have the entire contents readily poured from the barrel for further processing at the product destination.

Additionally, in the preferred embodiment of this invention, two discrete plastic mixing vanes are affixed to the internally previously coated surface of a disposable 55 gallon drum. Each vane is L-shaped in configuration and helically disposed in the central portion of the barrel between the two cold rolled ribs reinforcing the barrel. Fastening of the vanes occurs to the barrel coating. A process for the vane attachment is disclosed.

A drum utilized in the food containment business is conventionally provided with a coating to resist corrosion from contained, cooked foods. A coating compatible adhesive is utilized is used over a portion of the drum and a corrosion resistance static mixing vane attached to the drum. There results a drum, drum coating, and adhered mixing vane combination which enables accelerated cooling of cooked food product by sprayed water over the drum, allows direct shipment to occur utilizing the same container, and permits contents to be readily emptied from the container.

According to a first example, a mixing vane is mounted interior of a drum having a plastic lining—preferably a vinyl lining. The mixing vane is preferably constructed with a T- or L-shaped section with the "T" or "L" fastened to the interior of the lined drum and the vertical member of the "T" or "L" protruding outward from the barrel wall as the mixing vane. In this embodiment, the vertical member of the "T" or "L" is disposed along a helical path to produce directional movement of the barrel contents during barrel rotation. Preferably, the mixing vane is injection molded from polyvinylchloride, the same generic material forming the coating of the barrel. In this case, the mixing vane is injection molded from polyvinylchloride. In fastening to the sidewall of the 55 gallon, the mixing vane is first softened at the top of the "T" or "L" by placement in a vinyl solvent to produce a sticky surface. Thereafter, the vane is placed, preferably by clamping, to the inside surface of the vinyl coated 55 gallon drum. There results a complete and simple bond of the vane to the drum which can withstand the temperatures of materials placed within the drum and effect desired mixing of the drum contents.

In a second and now preferred example, a polyethylene vane is bonded to the sidewall of the drum in the following manner:

1. Initially the drum shell is lined with polymeric coating and baked to cure the lining. As a preparation for attachment of the vane, the area of the drum where the vane is to be bonded is coated with a different polymeric coating that promotes bonding of polyethylene to the lined surface. In this case the coating used is Courtaulds Coatings LVP9624, part of their IP3138 series, sold by the Courtaulds Coatings Co. of Louisville, Ky. The lacquer is either dusted with polyethylene powder or a strip of thin (4 mil) polyethylene film is laid on the coated area while still wet, or polyethylene powder is incorporated in the lacquer.

An alternate method of preparation is to line the drum with the vinyl and then lay a thin polyethylene strip coated on one side with the Courtaulds' material in the area where bonding is desired.

2. The drum shell is then baked in an oven to cure the bonding agent.

3. The drum shell is then reheated in the area where the bonding material has been applied, softening the polyethylene mixed in the lining. The polyethylene vane is then pressed into contact with the softened polyethylene in the lined area. This provides a suitable bond of the polyethylene vane which will withstand the temperatures of the materials placed in the drum and effects the desired mixing of the drum contents.

BRIEF DESCRIPTION OF THE DRAWINGS

FIGS. 3–6 illustrate the process of attaching the two 120° vanes of this invention to the interior of a cylindrical 55 gallon drum in which:

FIG. 3 illustrates a conventionally coated cylindrical drum interior having additional adhesive applied along a helical path for fastening the bottom horizontal section of the L-shaped mixing vane to the barrel side;

FIG. 4 is a perspective view of an apparatus for applying the L-shaped vane including a pressing attachment for reaching interior of the barrel with the L-shaped mixing vane and an exterior hot air heating manifold for heating the barrel to receive the L-shaped mixing vane;

FIG. 5 illustrates the apparatus of FIG. 4 with a barrel disposed in the heating manifold and an L-shaped mixing vane grasped by the pressing attachment;

FIG. 6 illustrates the interior of the barrel to attachment of one of the two 120° mixing vanes; and, FIG. 7 illustrates actual cooling data taken from the drum illustrated in FIG. 1 where diced tomato product was cooled utilizing the drum of this disclosure.

DESCRIPTION OF THE PREFERRED EMBODIMENT

Figure 1:
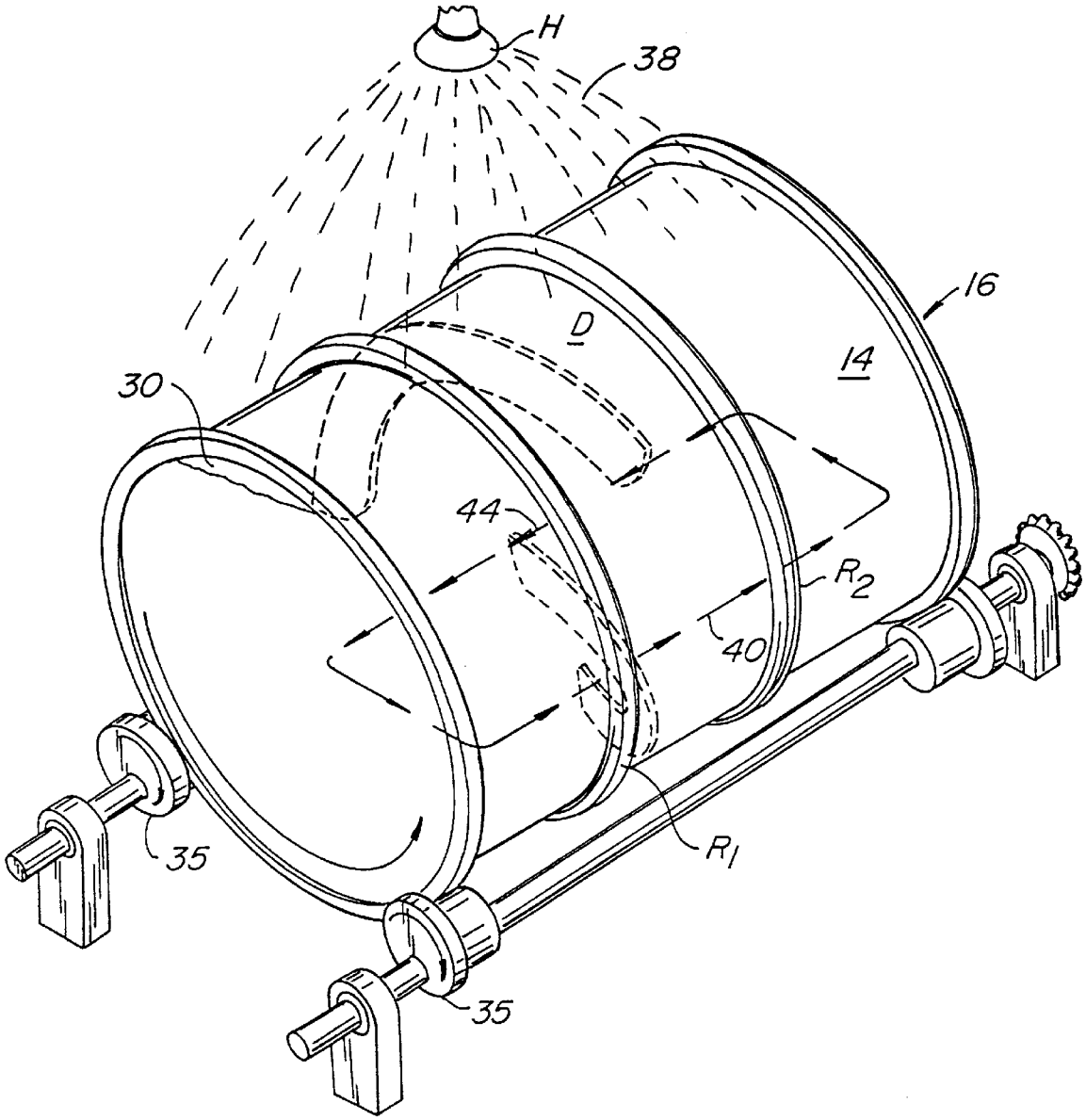
FIG. 1 is a perspective view of a prior art cooling tunnel conventionally used for the cooling of rotated drums cooling a drum with the vanes of this invention installed within the drum.
Figure 2:
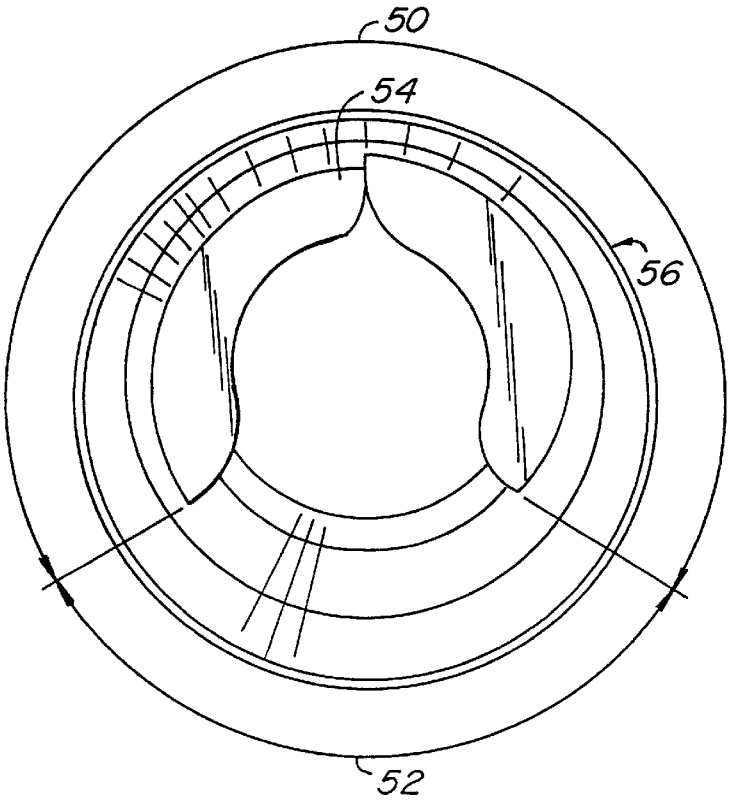
FIG. 2 is a perspective view with the opened head of a 55 gallon drum removed illustrating two 120°'s mixing vanes each attached to the interior coated drum occupying an internal cylindrical solid angle of about 240° of the drum with about 120° of the internal cylindrical solid angle of the drum unoccupied so that contents can be readily poured from the drum.

Referring to FIGS. 1 and 2, the preferred embodiment of the disposable 55 gallon drum D with mixing vanes V is illustrated. Specifically, the perspective view illustrates an open head drum having two mixing vanes V. Vanes V each have an L-shaped section, extend over 120° of cylindrical arc, and are disposed on interior coated wall 56 in a helical path.

It will be seen that only two vanes V are utilized and that together they occupy internal cylindrical solid angle 50 of approximately 240°. This leaves unoccupied internal cylindrical solid angle 52.

Preferably, vanes V are registered to cylindrical seam 54 in barrel cylindrical wall 56. By registering vanes V to this seam, unoccupied internal cylindrical solid angle 52 results. This unoccupied internal cylindrical solid angle 52 enables the contents of drum D to be easily poured without interference from vanes V.

We use the term, "cylindrical solid angle." Although the plain meaning of this term is believed understandable, we take the time to describe it herein.

Specifically, we refer to an angle taken from the axis of the cylinder from which drum D is defined normal to the axis of the cylinder. This angle is defined on the interior side wall of the cylinder. Once the angle is defined, it is projected axially along the cylinder without rotation. We define this as a "cylindrical solid angle." Naturally, that portion of the inside wall of the container that this solid angle encompasses is the area that is either occupied by mixing vanes or is unoccupied by mixing vanes so that contents can be poured from the drum.

For attachment of vanes V, we have a continuous solid angle of at least over 180° of the interior cylindrical wall occupied by vanes V. Preferably, vanes V occupy 240° of the wall.

At the same time, to enable the contents to be poured from drum D, it is required that vanes V not occupy at least 90° of the interior cylindrical surface of drum D. In the preferred embodiment, this unoccupied interval is a cylindrical solid angle of 120°.

Having set forth the general description of drum D attention can now be turned to FIG. 1. Drum D is to be understood loaded with diced tomato product. In the normal case, so-called 55 gallon drum D will be loaded with 55 gallons of diced tomato product. The interior of drum D defines a volume of 57 gallons. Accordingly, there exists free space 30 at the top of drum D.

Figure 3:
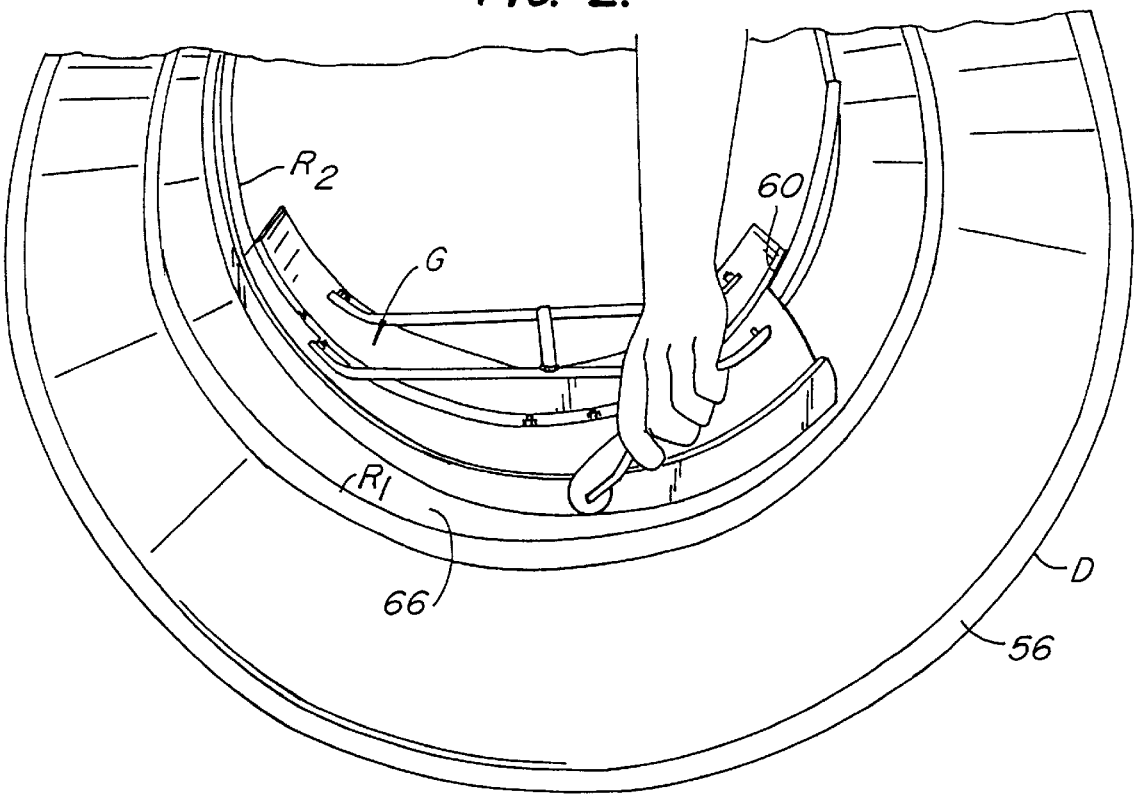

In the case of hot diced tomatoes, drum D is loaded with product and then sent to a rotation station, such as that schematically illustrated in FIG. 3. Drum rotators 35 cause drum D to rotate. During such rotation, free space 30 remains roughly at the top of drum D.

It is required that drum D be subjected to spray during rotation. Accordingly, spray head H releases cooling water 38 on the exterior of drum D during rotation on drum rotators 35.

In this invention, rapid rotation of the drum is employed.

It will be understood that with respect to the prior art, drum rotators 35 enabled the exterior surface of product to be cooled rapidly. The problem was that product in and along the central axis of the drum did not undergo rapid cooling. Vanes V obviate this problem.

When drum D rotates on drum rotators 35 or stops on drum rotators 35, relative movement between product contained in drum D and cylindrical side wall 14 occurs. Vanes V take advantage of this relative movement. Specifically, vanes V act like an internal auger flight and serves to displace product along the cylindrical side wall. Specifically, product is displaced along path 40 to one end of drum D.

On reaching the end of drum D, the product is displaced along the inside of circular end 16. Thereafter, flow occurs centrally and axially of drum D along axial path 44. This flow continues until contact with removable drum cap C occurs. Thereafter, flow occurs along the inside surface of removable drum cap C with return to cylindrical side wall 14. Circulation of the central cylindrical portion of the stored product occurs to the interior cylindrical side walls of drum D. This enables thorough cooling of all product interior of drum D to occur.

Having set forth the now preferred construction, the method and apparatus for the insertion of vanes V will be discussed.

Referring to FIG. 3, drum D is illustrated having both ends open with barrel cylindrical wall 56 and ribs $R_1$–$R_2$ formed within the cylindrical wall. Helical guide G is fitted to rib $R_2$ at corresponding V-groove 60 in the helical guide. Typically, one end of helical guide G is registered to cylindrical seam 54. Thereafter, utilizing roller 62, additional helical coating of adhesive 66 is placed on coating 64 of drum D.

A word about the standard coating of drum D. Specifically, drum D has barrel cylindrical wall 56 cold rolled from 18 to 22 gauge steel. The interior wall of this steel is tin coated. On top of this tin coating there is placed a 0.2 mil thickness vinyl lining. More precisely, vinyl lining is placed on the interior surface of the tin coated steel to a thickness of 70 mg./4 $in^2$.

Additional helical coating of adhesive 66 added by roller 62 is Courtaulds Lacquer manufactured by the Courtaulds Company of Mojave, Calif. This lacquer can either be mixed with polyethylene powder—or the still moist lacquer can be dusted with sufficient powder to apply the coating. After application of the lacquer and coating, baking of drum D occurs at 400° F. for a period of 10 minutes. This leave the interior coating of drum D ready to receive vanes V with the bonding coating now adhering to the originally placed drum coating.

Figure 4:
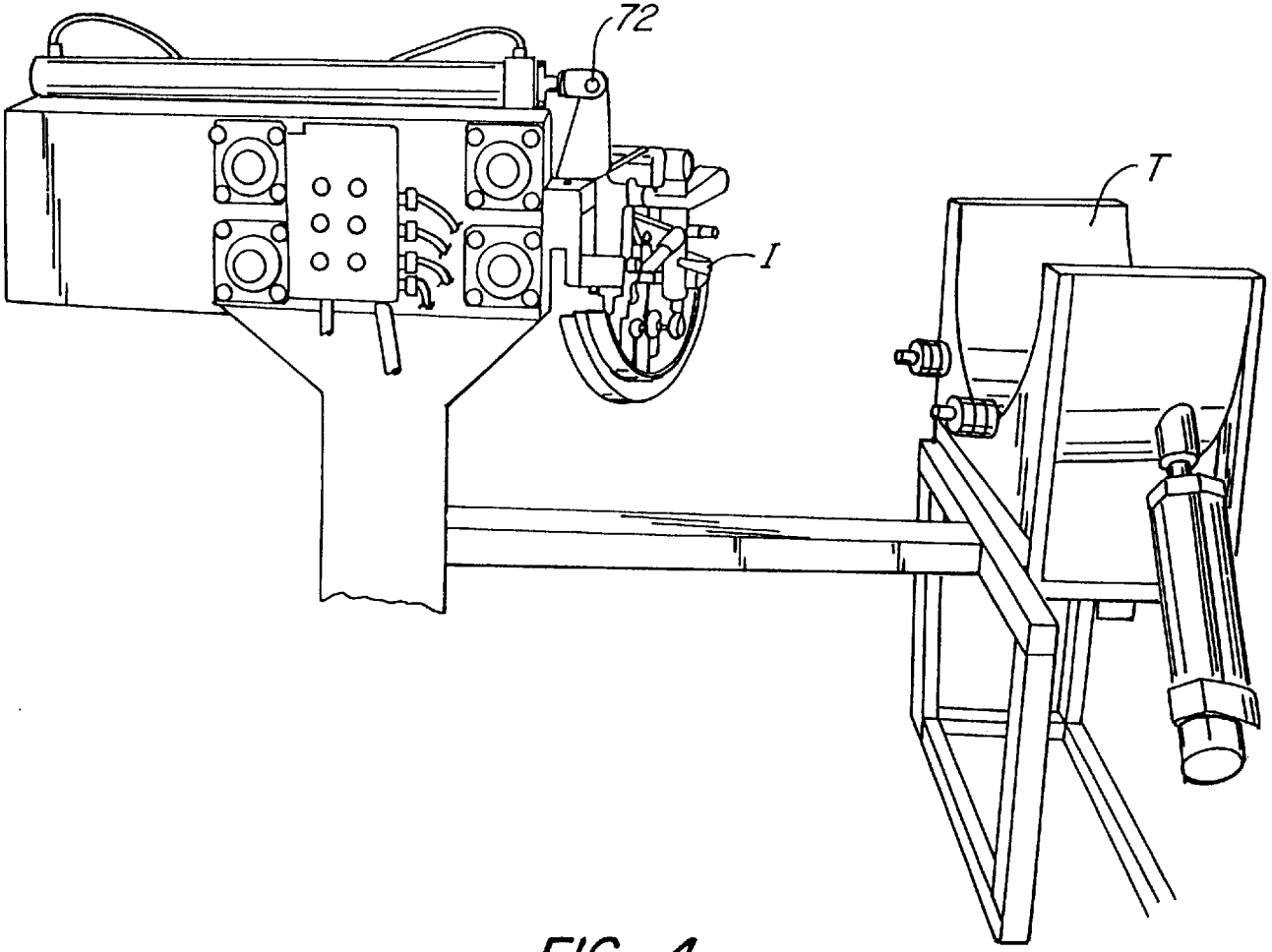

Referring to FIG. 4, rib inserter I and external barrel wall heater T are illustrated. Rib inserter I includes helical mandrel 67. Helical mandrel 67 registers to the flat portion of L-shaped vane V at suction cups 70 (See FIGS. 4 and 6).

Figure 5:
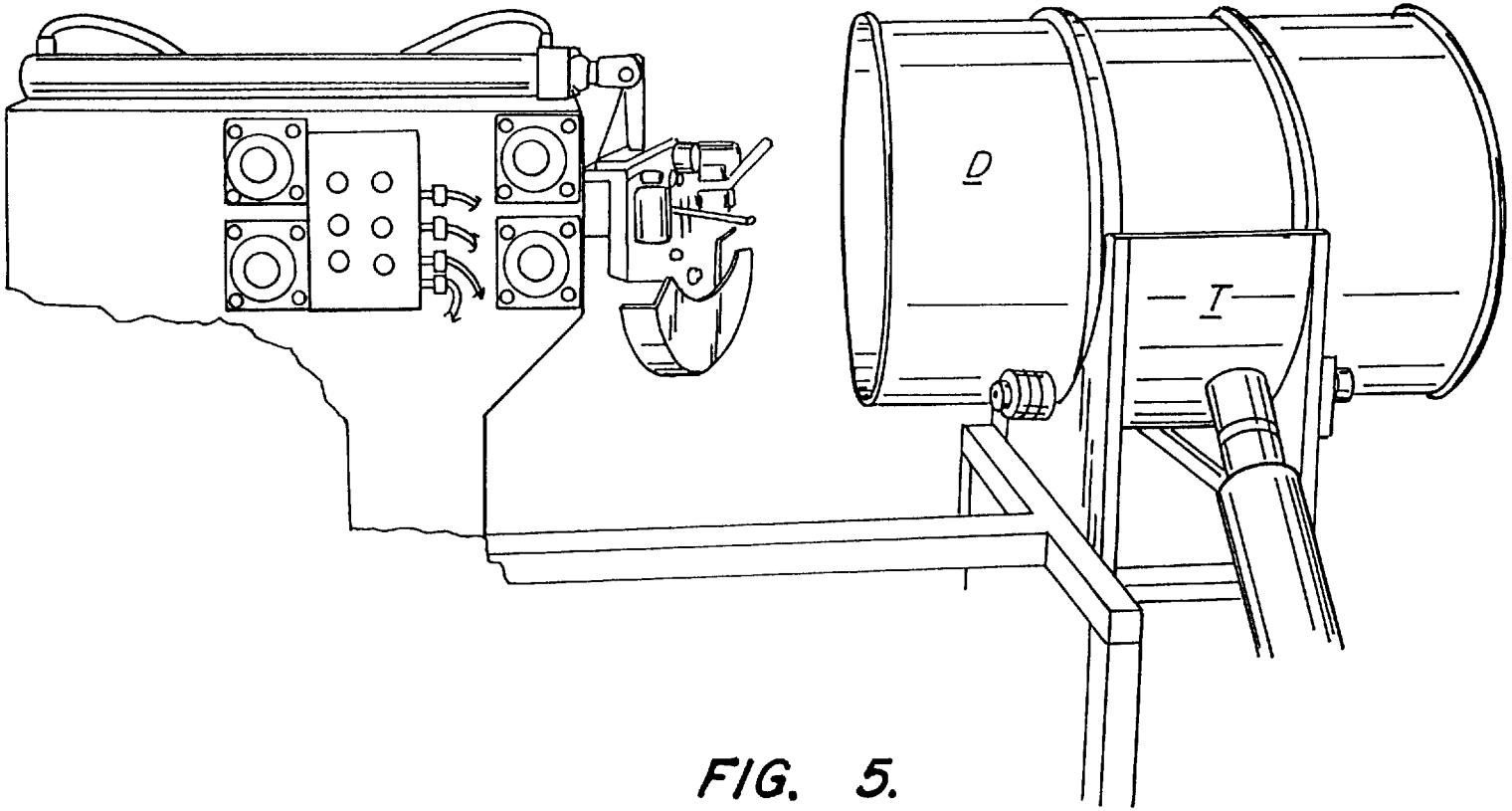

With reference to FIG. 5, drum D is shown registered to external barrel wall heater T and is having its outside periphery heated. This heating is produced by heated air impacting the painted outside of drum D and transfers to the inside at additional helical coating of adhesive 66. Air temperature is in the range from 450° to 600° F.

Figure 6:
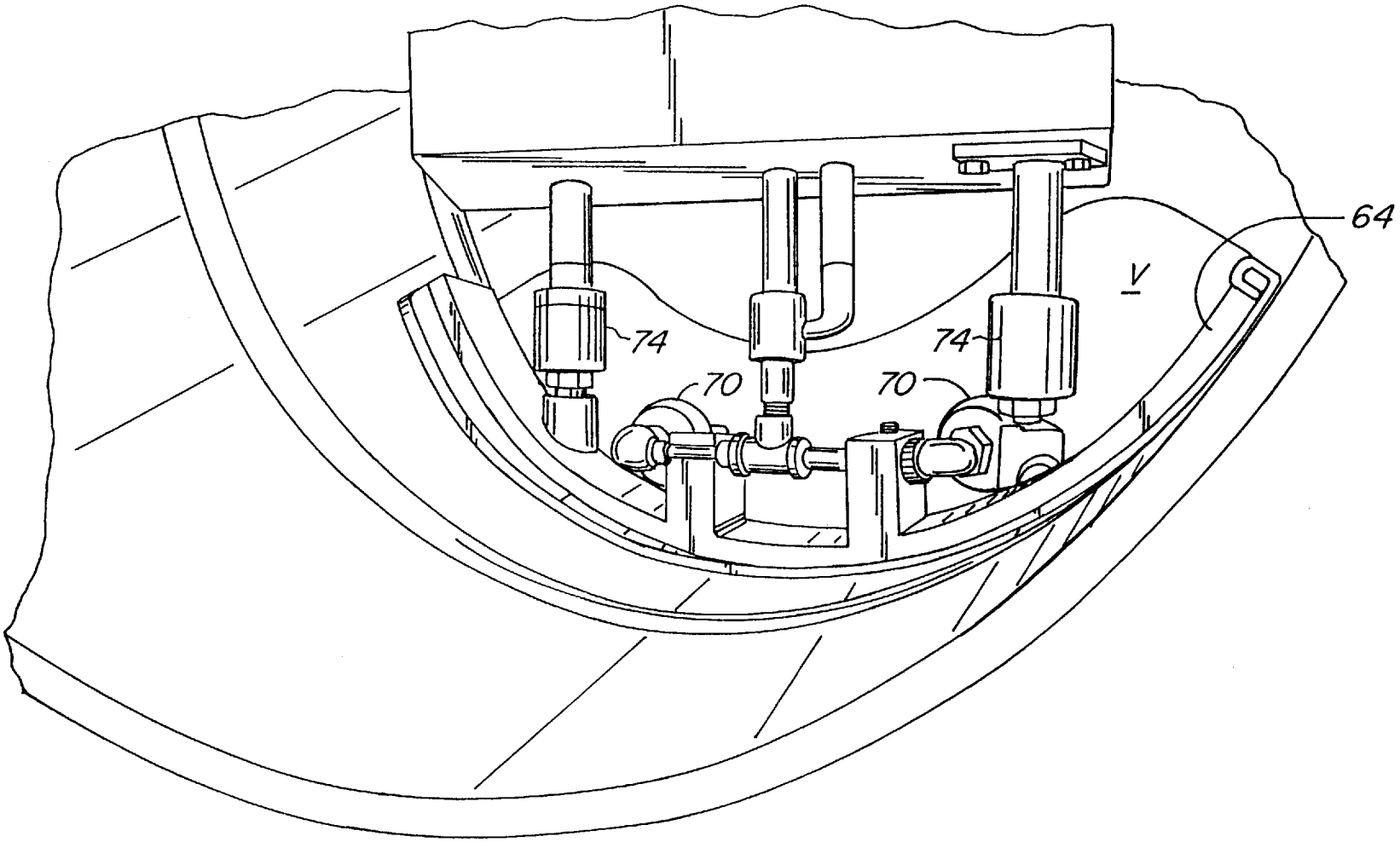

Referring to FIG. 6, rib inserter I is then registered interiorly of the open end of drum D and compressed down on additional helical coating of adhesive 66 which is in turn on interior coated wall 56 of the drum. This registration occurs through the expansion of arm 72 and downward compression at cylinders 74. Attachment of vanes V occurs.

The specific chemical composition of the adhesive used to hold the vane V to the drum D can vary. What follows are two specific embodiments which we have utilized.

As is well known in the art, cylindrical side walls of 55 gallon drum D are coated on the inside. Specifically, a polymeric coating containing polyvinylchloride is applied to the interior of 55 gallon drum D. Rigid control on wet film thickness is maintained—with 1.6 to 2.0 mils on a roll gauge. Drying of the film occurs at a bake temperature of 400°±10° F. A dry film lining weight of 50–70 mg/4 $in^2$ is preferably achieved.

A section of the mixing vane V is illustrated attached to cylindrical side walls S. Mixing vane V can be "T" shaped in section with the top of the "T" forming mixing vane base and the vertical member of the "T" forming protruding mixing member. As can be seen mixing vane V is disposed on cylindrical side walls S in a helix.

As will be understood, "L" shaped vanes are here preferred and can be used for attachment as well.

There remains to set forth first the material from which mixing vane V is extruded or molded and secondly the method of attachment of mixing vane V to cylindrical side walls.

Mixing vane V preferably constitutes extruded vinyl. This vinyl is solvent in MEK (methyl ethyl ketone). In the first embodiment, when mixing vane base has MEK applied, extruded mixing vane V become soft and sticky at mixing vane base. When mixing vane V is soft and sticky at mixing vane base, it is ready for application to the interior of cylindrical side walls.

In the second and preferred embodiment of this invention, mixing vane V constitutes injection molded polyethylene. The polyethylene becomes soft upon heating. Accordingly, when vane base held to the heated cylindrical side walls at the base of the vane where the bonding material has been applied, the polyethylene fuses and the vane adheres firmly to the inside of 55 gallon drum D.

With the sticky mixing vane base, mixing vane V is clamped or held to the inside cylindrical side walls at the vane in the direction toward the interior side walls. Such holding continues until mixing vane V adheres firmly to the inside of 55 gallon drum D.

It will be appreciated that I have shown one preferred embodiment of the fastening of mixing vane V to the inside of cylindrical side walls S. It will be apparent that other fastening will work. It is necessary that the inside of 55 gallon drum D be coated. It is further necessary that both the mixing vane itself and the coating resist the corrosive action of the contained food—in this case the generally acidic composition of the diced tomatoes. Further, it is only necessary that mixing vane V at mixing vane base 30 be heated or otherwise treated on the outside or the sidewall S be heated so that the vane adheres firmly to a coating on the inside of cylindrical side walls S of 55 gallon drum D.

It will be understood that in the preferred embodiment, mixing vane V is attached after the coating and curing of the lining and bonding material to the inside of cylindrical side walls S has occurred. It will be understood that the plastic vanes—here shown as molded or extruded polyethylene—are preferred over their metal counterparts. Such material cannot usually be attacked by the either caustic or acid contents of the barrel. Further, problems of scrap—and especially scrap introduced to the interior of 55 gallon drum D are avoided.

Figure 7:
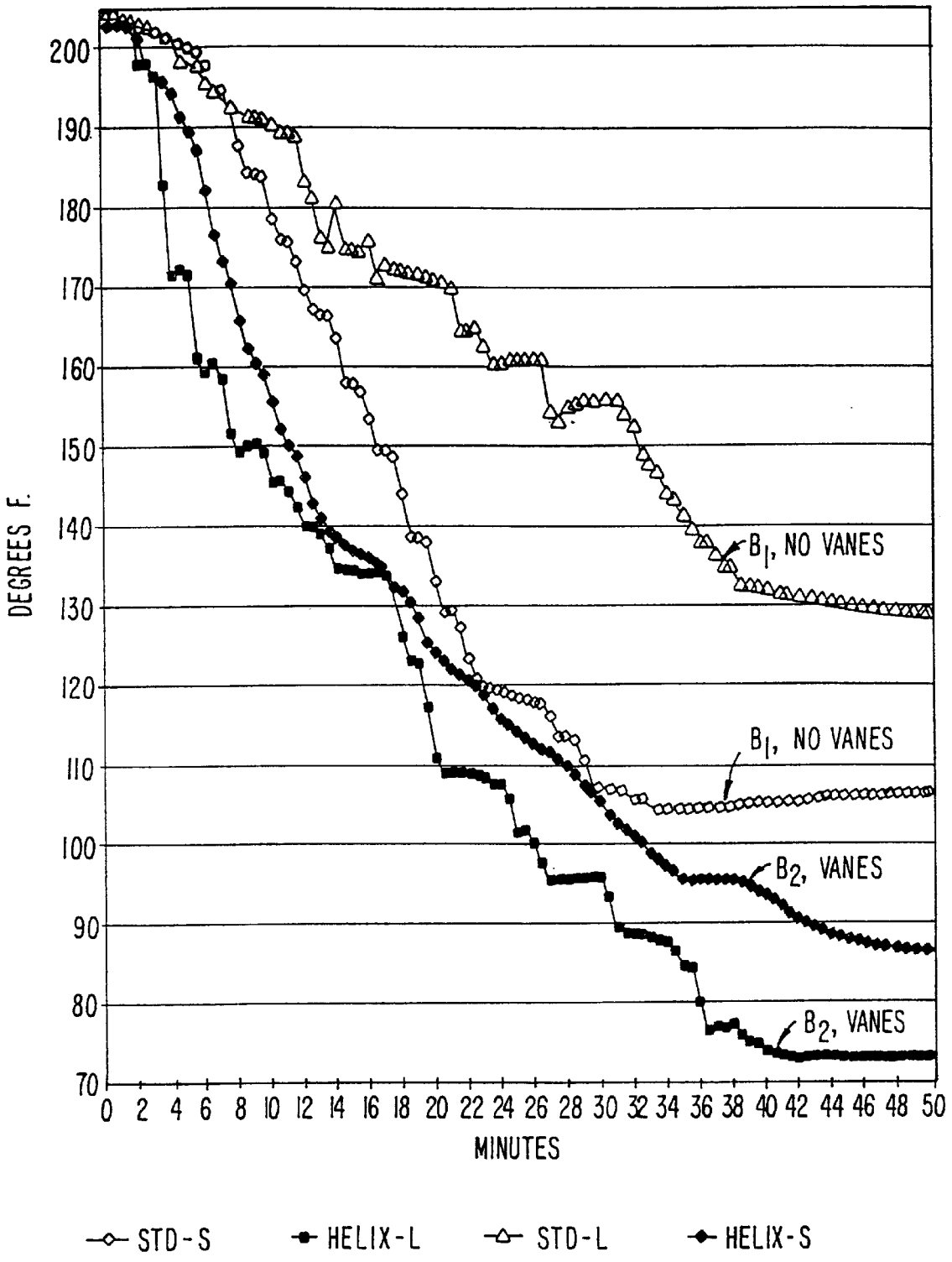

Referring to FIG. 7, a comparative graphical representation of the cooling of a 55 gallon drum filled with diced tomatoes is represented.

Referring to curves $A_1$ and $A_2$, these are respective curves for a standard drum and a drum with static mixers according to the preferred embodiment containing tomato strips in puree—with 276 pounds of tomato strips in 189 pounds of puree.

Test #1—Tomato strips in puree—276 lbs of tomato strips in 189 lbs. of puree.

Fill temperature—194° F.

Two Helix drums and one control drum were run with temperature tracers located in the center of the drums. The tests show no significant improvement in cooling performance from the Helix. The cooling curves indicate that the Helix mixed the product since the cooling curve shows uniform cooling indicating no hot spots while the control drum showed the cooling erratic with some temperature rises and dramatic drops. However, the final temperatures in the drums showed no significant differences. This is attributed to the fluid nature of this product which apparently did not realize the full benefit of the Helix for cooling. Sampling by inserting a thermometer in the drum after opening indicated fairly uniform temperatures throughout the drum. The results are indecisive on the benefit of the Helix. It appears to mix the product better but the final temperature results do not show the benefit.

Referring to curves $B_1$ and $B_2$, these are respective curves for standard drums and drums with static mixers according to the preferred embodiment containing 399 pounds of diced tomatoes in 65 pounds of juice.

Test #2—½ inch diced tomatoes in Juice—399 lbs of diced in 65 lbs of juice.

Fill temperature 202° F.

Two Helix drums and two control drums were run with temperature tracers located in the middle of the drums. This test showed a significant contribution to cooling from the Helix drums (see FIG. 7. The final temperatures indicated on the tracers were 75° and 94° F. for the drums having vanes (curves $B_2$) and 108 and 132° F. for the control drums having no vanes (curves $B_1$). Temperatures obtained by inserting a thermometer in the drums after opening indicated temperatures ranging from 84° to 90° F. in the Helix drums and temperatures from 84° to 112° F. in one control drum and 84° to 132° F. in the other. There were spots in the second control drum that were too hot to hold a hand in. The conclusion is that the Helix contributed significantly to cooling this product, providing a final temperature throughout the Helix drums that was uniform and well below temperatures experienced in the control drums.

In all cases, the cooling rate of rotation was 30 rpm utilizing a 20 station cooling tunnel having chilled water at 42° F. sprayed over the drums and a temperature rise within the tunnel of 10° F. to 52° F. with a dwell time of two minutes at each station with a total dwell time of 40 minutes within the tunnel. It is seen that for the diced tomatoes used with the preferred static mixers of this invention, the cooling time is dramatically shorter. In both cases, temperature is uniformly distributed in those drums where static mixers are used.

It will be understood that cooling tunnels or stations can be a restricting factor in plants where large quantities of cooked fruit or vegetable product are required. By utilizing the rotation of this invention, such cooling tunnels can be increased in capacity of a factor approaching 100%.

We have illustrated the preferred placement of static mixer M with a open head drum. It will be understood that use with a so-called "closed head" drum can likewise occur. Further, use for only cooling is not required. Many drum transported products can utilize thorough mixing during storage and transport. By the expedient of rotating drum D containing such product, mixing can occur.

We illustrate our invention with a 55 gallon steel drum. Restriction to such a specific kind of container is not required. While we preferred to utilize our invention within such a drum, the invention can be practiced with other types of containers utilized for the cooling, storage and transport of product.

What is claimed is:

1. In a container for cooling, storing and transporting product having static mixers comprising:

a cylindrical container body defining an interior cylindrical wall about a central axis and having a circular opening at one end of the cylindrical container;

static mixers fastened to the interior cylindrical wall at a cylindrical solid angle relative to the central axis of more than 180° of the interior cylindrical wall of the container; and, the interior cylindrical wall having a solid angle relative to the central axis unobstructed by the static mixers of at least 90° whereby contents can be poured from the barrel without interference by the static mixers at the interior cylindrical wall of the container.

2. In a container for cooling, storing and transporting product having static mixers according to claim 1 and wherein:

static mixers fastened to the interior cylindrical wall at a cylindrical solid angle of 240° relative to the central axis.

3. In a container for cooling, storing and transporting product having static mixers according to claim 1 and wherein:

the interior cylindrical wall having a solid angle unobstructed by the static mixers of 120° relative to the central axis.

4. In a container for cooling, storing and transporting product having static mixers according to claim 1 and wherein:

the static mixers are helical vanes.

5. In a container for cooling, storing and transporting product having static mixers according to claim 4 and wherein:

the helical vanes each occupy 120° of the internal cylindrical solid angle of the drum relative to the central axis.

6. In a container for cooling, storing and transporting product having static mixers according to claim 1 and wherein:

the container is a 55 gallon drum.

* * * * *